US006995648B2

(12) United States Patent
Jur et al.

(10) Patent No.: US 6,995,648 B2
(45) Date of Patent: Feb. 7, 2006

(54) FUSE BARRIER AND POWER CIRCUIT EMPLOYING THE SAME

(75) Inventors: Arthur J. Jur, Greenwood, SC (US); Douglas M. Brandt, Greenwood, SC (US); Mark A. Faulkner, Greenwood, SC (US)

(73) Assignee: Eaton Corporation, Cleveland, OH (US)

( * ) Notice: Subject to any disclaimer, the term of this patent is extended or adjusted under 35 U.S.C. 154(b) by 218 days.

(21) Appl. No.: 10/730,836

(22) Filed: Dec. 9, 2003

(65) Prior Publication Data

US 2005/0122203 A1 Jun. 9, 2005

(51) Int. Cl.
*H01H 85/36* (2006.01)
*H01H 85/38* (2006.01)

(52) U.S. Cl. ..... 337/278; 337/190; 337/239; 337/165

(58) Field of Classification Search ..... 337/157, 337/191, 165, 261, 278, 217–220, 238–240, 337/190; 439/621, 622, 893; 340/638
See application file for complete search history.

(56) References Cited

U.S. PATENT DOCUMENTS

| | | | | | |
|---|---|---|---|---|---|
| 1,005,517 | A | * | 10/1911 | Daum | 337/238 |
| 1,761,760 | A | * | 6/1930 | Van Der Bogart | 337/157 |
| 2,148,542 | A | * | 2/1939 | Dietz | 337/219 |
| 2,282,279 | A | * | 5/1942 | Xenis | 337/291 |
| 2,284,291 | A | * | 5/1942 | May | 337/164 |
| 2,769,059 | A | * | 10/1956 | Baenziger | 337/251 |
| 2,794,097 | A | * | 5/1957 | Jacobs, Jr. | 337/278 |
| 2,934,622 | A | * | 4/1960 | Massar | 337/157 |
| 3,265,841 | A | * | 8/1966 | Greber | 337/219 |
| 3,517,366 | A | * | 6/1970 | Patrichi | 337/148 |
| 4,002,864 | A | | 1/1977 | Kuhn et al. | |
| 4,050,045 | A | * | 9/1977 | Motten et al. | 337/187 |
| 4,059,816 | A | | 11/1977 | Bonecutter et al. | |
| 4,451,814 | A | * | 5/1984 | Barry et al. | 337/407 |
| 5,015,514 | A | | 5/1991 | Rinehart | |
| 5,130,688 | A | * | 7/1992 | Van Rietschoten et al. | 337/231 |
| 5,406,245 | A | | 4/1995 | Smith et al. | |
| 6,157,286 | A | | 12/2000 | Ranjan et al. | |
| 6,194,988 | B1 | * | 2/2001 | Yamaguchi et al. | 337/157 |
| 6,407,897 | B1 | | 6/2002 | Yanniello et al. | |
| 6,459,554 | B1 | | 10/2002 | Meiners et al. | |
| 6,510,047 | B2 | | 1/2003 | Meiners et al. | |
| 6,642,834 | B1 | * | 11/2003 | Oh et al. | 337/282 |

FOREIGN PATENT DOCUMENTS

JP 06084446 A * 3/1994

* cited by examiner

*Primary Examiner*—Anatoly Vortman
(74) *Attorney, Agent, or Firm*—Martin J. Moran

(57) ABSTRACT

A power circuit includes a first low voltage power bus, a second low voltage power bus, a fuse electrically connected between the first low voltage power bus and the second low voltage power bus, and a fuse barrier. The fuse has a non-interrupted state and an interrupted state. The fuse barrier includes a spring having a first end and a second end, a fastener connecting the first end of the spring to one of the first low voltage power bus and the second low voltage power bus, and an insulating barrier. The insulating barrier is disposed from the second end of the spring. The insulating barrier engages a portion of the fuse in the non-interrupted state thereof. The spring drives a portion of the insulating barrier through the fuse in the interrupted state thereof.

21 Claims, 7 Drawing Sheets

FUSE BARRIER AND POWER CIRCUIT EMPLOYING THE SAME

BACKGROUND OF THE INVENTION

1. Field of the Invention

The present invention relates to power circuit interruption and, more particularly, to fused circuit interruption of low voltage power busses.

2. Background Information

Copper Z, copper Y and S fuse links are designed to handle relatively high currents (e.g., about 800 A to about 6 kVA) and low voltage (e.g., up to about 600 $VAC_{RMS}$). The interrupting mechanism for the fuses (e.g., copper Z; copper Y) is the heat generated by passing fault level currents through a relatively small cross-sectional area of the fuse. The short period of time of elevated current does not allow sufficient time for the heat generated by the elevated current to dissipate throughout the fuse mountings. Eventually, the fuse will melt enough to create a gap in the fuse. The voltage will create an arc between the opposite ends of the gap, and the arcing will continue until the arc evaporates enough material, in order that the gap is extended enough distance that the arc can no longer be supported and is, thus, extinguished.

A network protector is a circuit breaker adapted to trip and open a feeder upon detection of reverse power flow (i.e., that is, power flowing through the feeder out of a network rather than into the network). Typically, overcurrent protection is provided by other devices, such as fuses, in series with the network protector. See, for example, U.S. Pat. Nos. 6,407,897; and 6,459,554.

U.S. Pat. No. 4,002,864 discloses a network protector including a drawout unit supported by a main support frame at ground potential. The drawout unit may be fully rolled out on extension rails of side plates of the main support frame. In that position, the drawout unit is completely disengaged from any source of high potential. A removable steel protective barrier covers the upper part of the drawout unit between the side plates. The protective barrier comprises a pair of handles, three quarter-turn fasteners mounted upon a flat steel plate and three glass polyester baffles. When the drawout unit is in the connected position, the baffles seat against flanges of the network protector enclosure, in order to contain any arcing products produced by operation of the network protector.

When a fuse or a plurality of fuses are employed in an enclosure (e.g., an enclosure for a network protector), the entire time that the arc is sustained, some metallic materials are vaporized, and other relatively larger, molten pieces of the fuse are thrown throughout the enclosure, thereby causing extensive damage to the protective barriers, and leaving a carbon and metallic dust over all components enclosed with the fuses. The length of time that the arc is sustained is the time that the fault is allowed to continue, thereby increasing potential damage to the equipment that the fuses are designed to protect.

There is room for improvement in power circuits employing fuses.

SUMMARY OF THE INVENTION

These needs and others are met by the present invention, which places a barrier between the opposite ends of the fuse as a sufficient gap is created to allow the barrier to pass through. The barrier is preferably made from a suitable arc suppressing material of sufficient size to prevent the arc from passing through the barrier or around it.

As one aspect of the invention, a fuse barrier is for a fuse electrically connected between a first low voltage power bus and a second low voltage power bus. The fuse barrier comprises: a spring including a first portion and a second portion; a fastener adapted to connect the first portion of the spring to one of the first low voltage power bus and the second low voltage power bus; and an insulating barrier disposed from the second portion of the spring, the insulating barrier being adapted to engage a portion of the fuse in a non-interrupted state thereof, the spring being adapted to drive a portion of the insulating barrier through the fuse in an interrupted state thereof.

The insulating barrier may be made of an arc suppressing material. The arc suppressing material may be adapted to prevent an arc from passing between the first low voltage power bus and the second low voltage power bus as the fuse transitions from the non-interrupted state to the interrupted state, in order to minimize dispersion of vaporized materials and molten portions from the fuse.

As another aspect of the invention, a fuse barrier is for a fuse electrically connected between a first low voltage power bus and a second low voltage power bus. The fuse barrier comprises: a spring including a first end and a second end; means for disposing the first end of the spring from one of the first low voltage power bus and the second low voltage power bus; and an insulating barrier disposed from the second end of the spring, the insulating barrier being adapted to engage a portion of the fuse in a non-interrupted state thereof, the spring being adapted to drive a portion of the insulating barrier through the fuse in an interrupted state thereof.

As another aspect of the invention, a power circuit comprises: a first low voltage power bus; a second low voltage power bus; a fuse electrically connected between the first low voltage power bus and the second low voltage power bus, the fuse having a non-interrupted state and an interrupted state; and a fuse barrier comprising: a spring including a first end and a second end, a fastener connecting the first end of the spring to one of the first low voltage power bus and the second low voltage power bus, and an insulating barrier disposed from the second end of the spring, the insulating barrier engaging a portion of the fuse in the non-interrupted state thereof, the spring driving a portion of the insulating barrier through the fuse in the interrupted state thereof.

The fuse may include a length between the first low voltage power bus and the second low voltage power bus. The fuse may also include a width, which is normal to the length. The portion of the insulating barrier may have a width, which is about equal to or greater than the width of the fuse.

The fuse may have a first end electrically and mechanically connected to the first low voltage power bus and an opposite second end electrically and mechanically connected to the second low voltage power bus. The fuse may melt and vaporize between the non-interrupted state and the interrupted state. A gap may be formed in the fuse as the fuse melts and vaporizes. The insulating barrier may be driven by the spring between the first and second ends of the fuse after the gap is formed, in order to allow the portion of the insulating barrier to pass through the gap of the fuse in the interrupted state thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "fastener" shall expressly include, but not be limited to, any suitable fastening member (s) (e.g., without limitation, a threaded fastener; a non-threaded fastener; a removable fastener; a non-removable fastener; a bolt; a machine screw; a rivet; a soldered connection; an adhesive connection), which is employed such that two or more parts are connected or coupled together.

Figure 1:
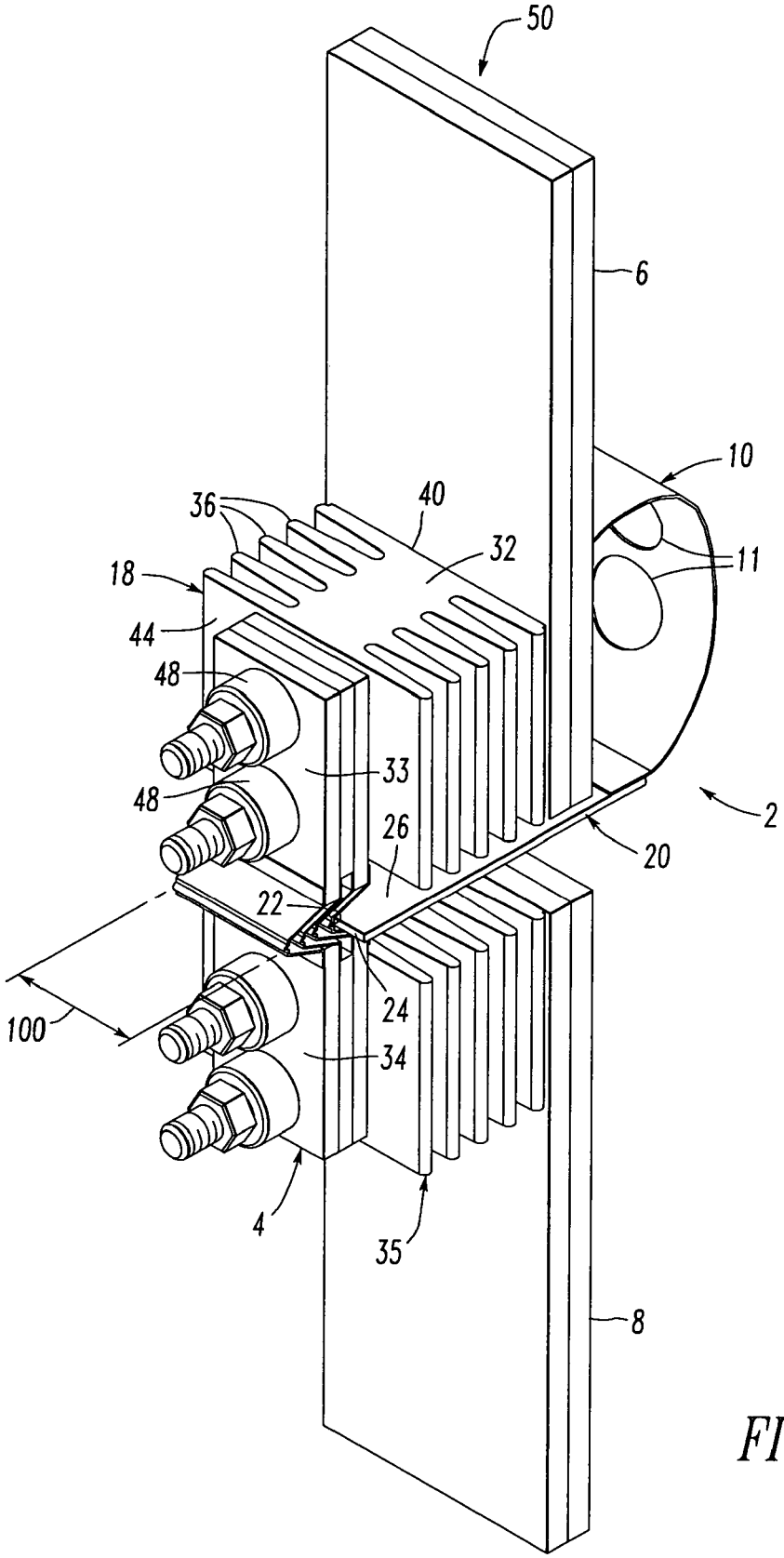
FIG. 1 is an isometric view of a power circuit including a fuse barrier in accordance with an embodiment of the present invention with the fuse barrier engaging a fuse in the non-interrupted state thereof.
Figure 2:
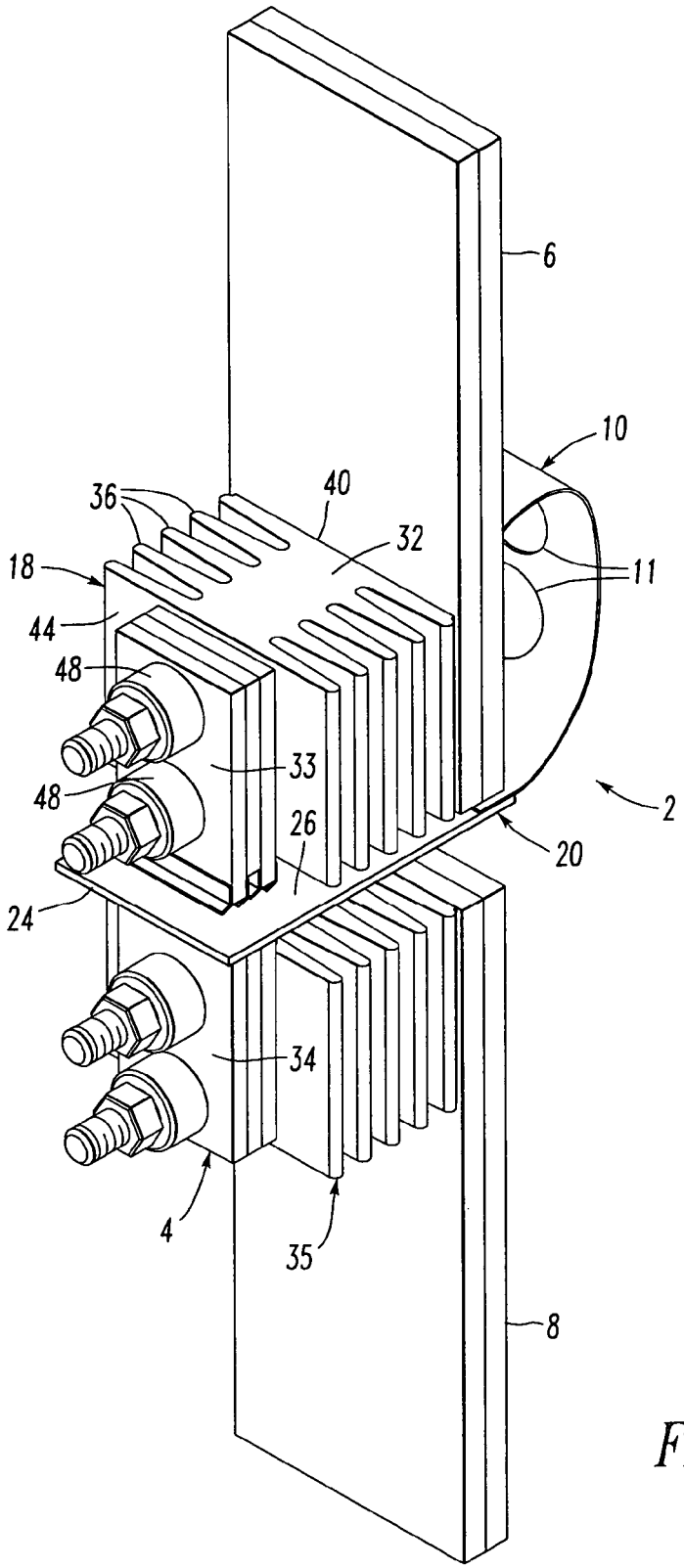
FIG. 2 is an isometric view of the power circuit of FIG. 1 with the fuse barrier passing through the fuse in the interrupted state thereof.
Figure 3:
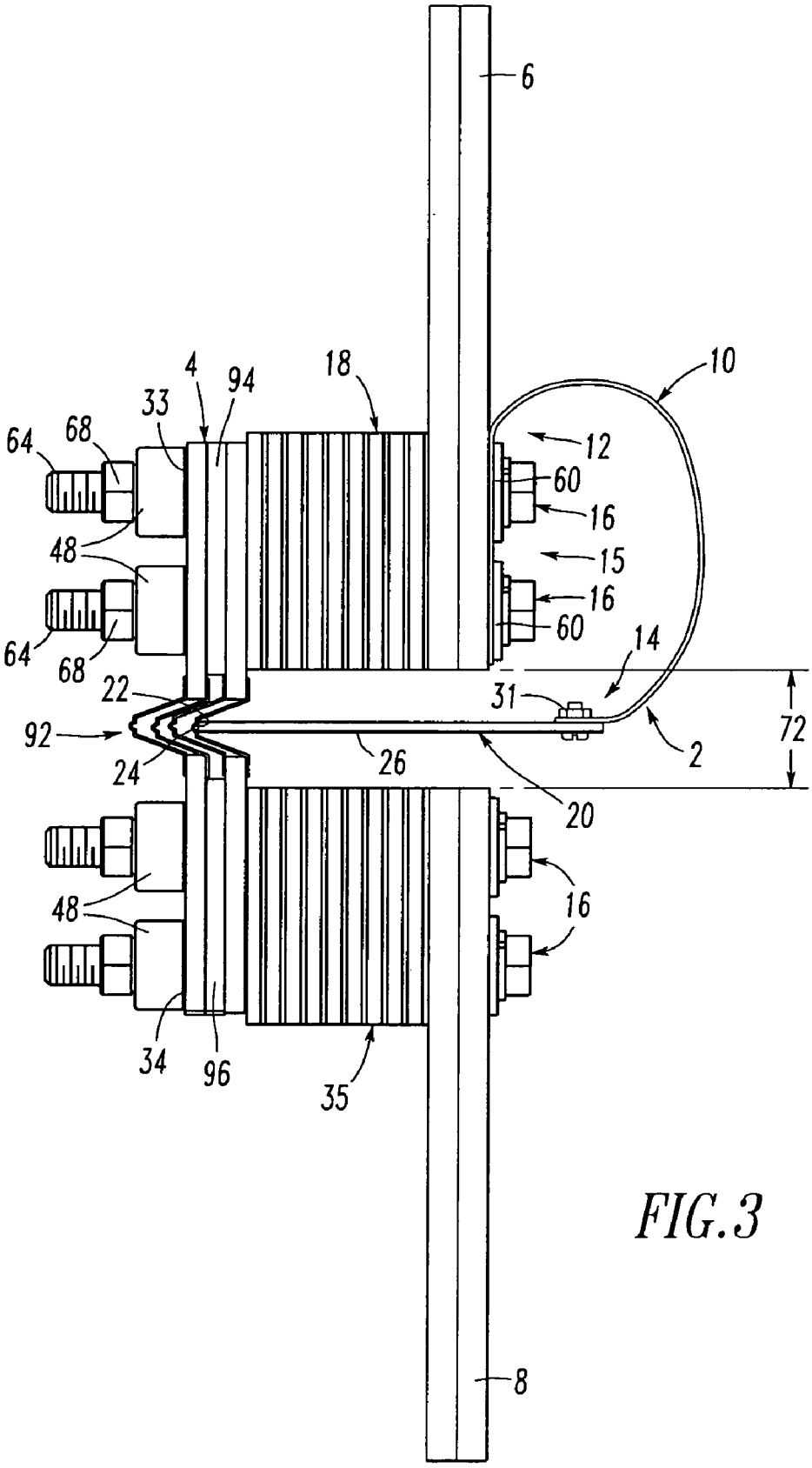
FIG. 3 is a vertical elevation view of the power circuit of FIG. 1.
Figure 4:
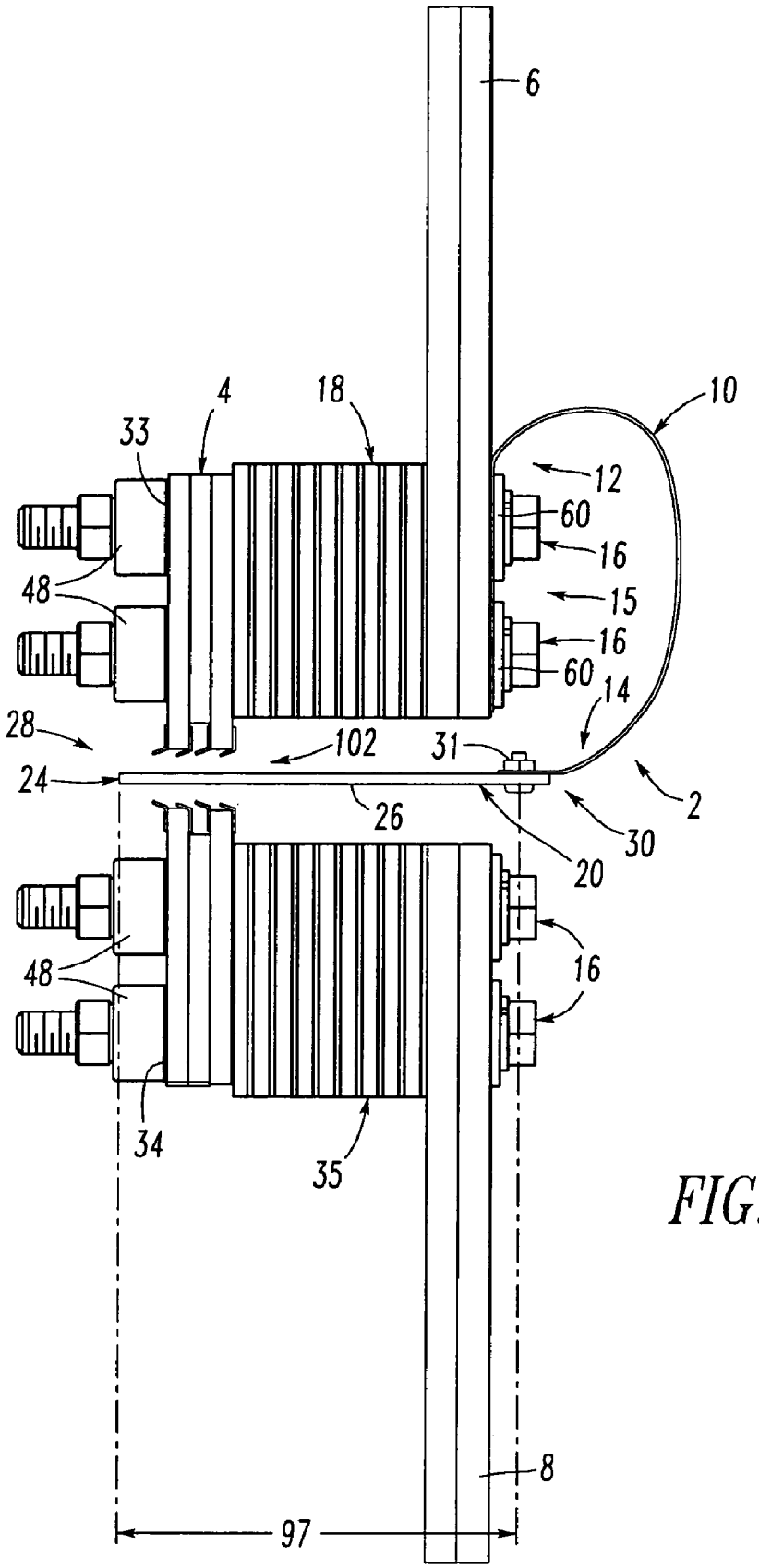
FIG. 4 is a vertical elevation view of the power circuit of FIG. 2.
Figure 5:
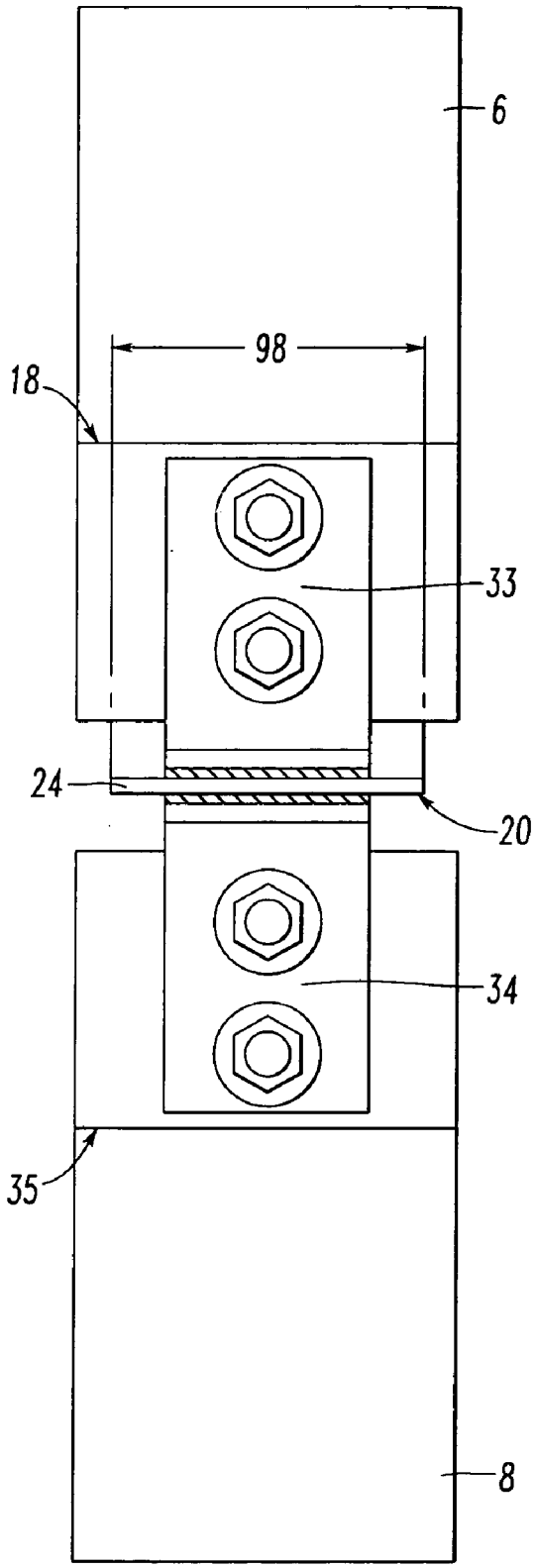
FIG. 5 is an end vertical elevation view of the power circuit of FIG. 4.

Referring to FIGS. 1 and 3, a fuse barrier 2 is for a fuse 4 electrically connected between a first low voltage power bus 6 and a second low voltage power bus 8. The fuse 4 has a non-interrupted state (as shown in FIGS. 1 and 3) and an interrupted state (as shown in FIGS. 2, 4 and 5). The fuse barrier 2 includes a spring 10 (e.g., made of steel) having openings 11 (e.g., for access), a first end 12 and a second end 14 (as best shown in FIGS. 3 and 4), and a fastener mechanism 15 (as best shown in FIGS. 3 and 4) for disposing the spring first end 12 from one (e.g., power bus 6) of the power busses 6,8. The fastener mechanism 15 includes one or more fasteners, such as 16, which are adapted to connect the spring first end 12 to the one (e.g., power bus 6) of the power busses 6,8. In this example, the fasteners 16 are also adapted to engage a heat sink 18. Although the power busses 6,8 are laminated, it will be appreciated that a wide range of such busses (e.g., non-laminated; solid) may be employed.

An insulating barrier 20 is disposed from the spring second end 14 and is adapted to engage a portion 22 of the fuse 4 in the non-interrupted state (FIGS. 1 and 3) thereof. The spring 10 is adapted to drive a portion 24 of the insulating barrier 20 through the fuse 4 in the interrupted state (FIGS. 2, 4 and 5) thereof.

Preferably, the insulating barrier 20 is made of a suitable arc suppressing material 26, such as, for example, fiber reinforced plastic resin, plastic resin coated fabric, vulcanized fabric, fiber reinforced polyester laminate and any suitable equivalent dielectric material. This arc suppressing material 26 is adapted to prevent an arc from passing between the first low voltage power bus 6 and the second low voltage power bus 8 as the fuse 4 transitions from the non-interrupted state to the interrupted state, in order to minimize dispersion of vaporized materials and molten portions (not shown) from the fuse 4. The insulating barrier 20 and the arc suppressing material 26 thereof are adapted to prevent the arc from passing through or around that insulating barrier.

As shown in FIG. 4, the insulating barrier 20 includes a first end 28 and a second end 30. The insulating barrier first end 28 includes the insulating barrier portion 24, which is adapted to drive through the fuse 4 in the interrupted state thereof. The insulating barrier second end 30 is connected to the spring second end 14 by the one or more fasteners 31 (only one of which is shown in FIGS. 3 and 4).

Referring again to FIGS. 1 and 3, the spring 10 biases the insulating barrier portion 24 (FIGS. 2–4) against the fuse U-shape 22 in the non-interrupted state (FIG. 3) thereof. The fuse 4 melts and vaporizes between the non-interrupted state and the interrupted state (FIGS. 2 and 4). The spring 10 drives the insulating barrier 20 through the fuse 4 as such fuse transitions from the non-interrupted state to the interrupted state, in order to minimize dispersion of vaporized materials and molten portions from the fuse 4.

The fuse 4 has a first end 33, which is electrically and mechanically connected to the first heat sink 18, which, in turn, is electrically and mechanically connected to the first low voltage power bus 6. The fuse 4 also has a second end 34, which is electrically and mechanically connected to a second heat sink 35, which, in turn, is electrically and mechanically connected to the second low voltage power bus 8.

Figure 6:
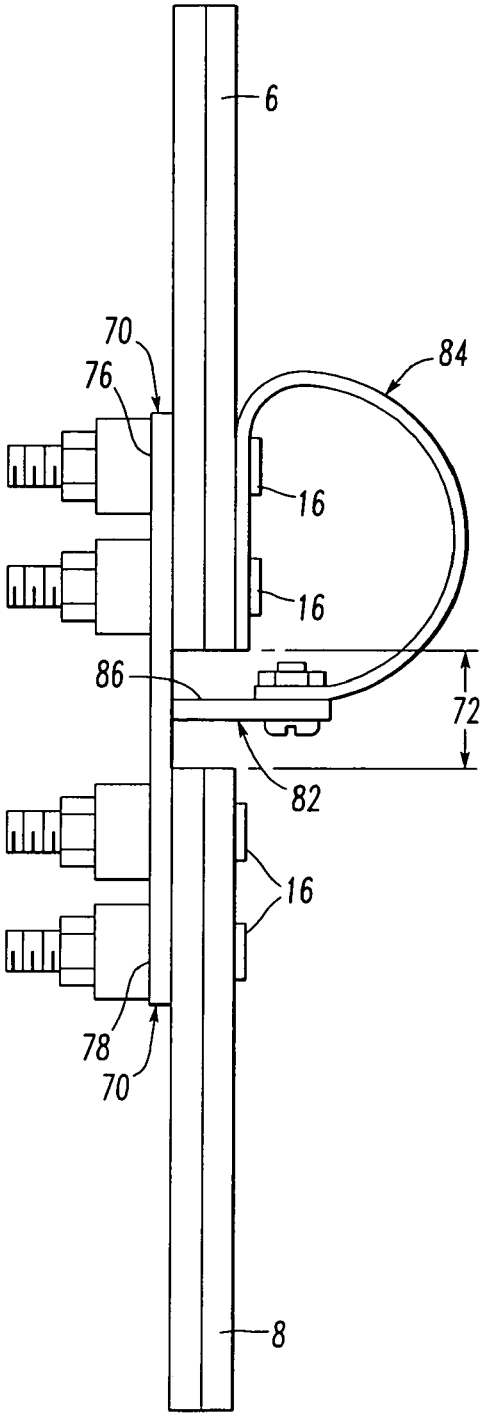
FIG. 6 is a vertical elevation view of a power circuit including a fuse barrier in accordance with another embodiment of the invention with the fuse barrier engaging a fuse in the non-interrupted state thereof.
Figure 7:
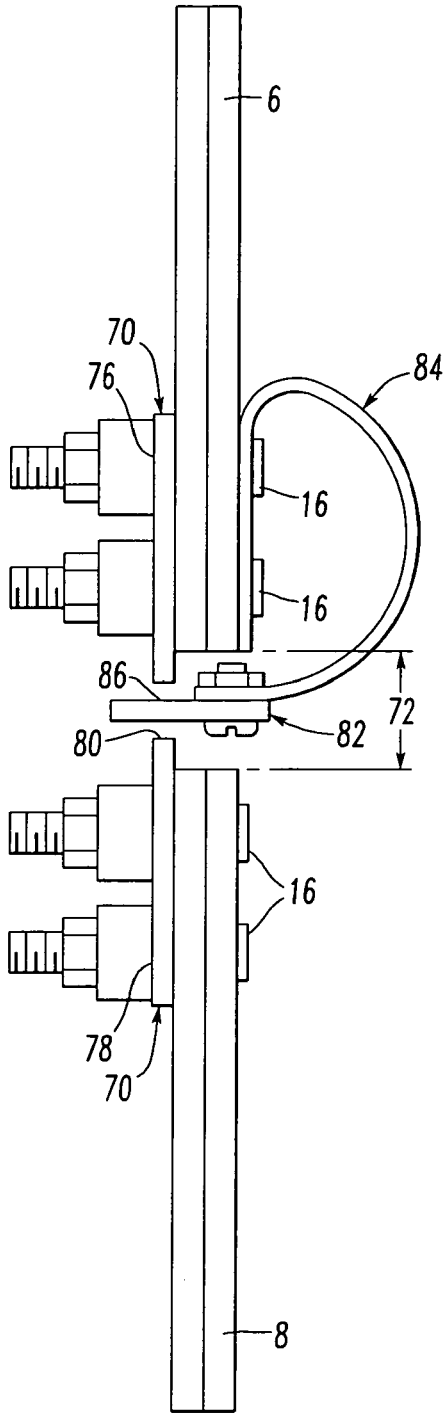
FIG. 7 is a vertical elevation view of the power circuit of FIG. 6 with the fuse barrier passing through the fuse in the interrupted state thereof.

An example of the conductive heat sinks 18,35 is disclosed in U.S. Pat. No. 6,510,047, which is incorporated by reference herein. As shown in FIG. 1, the conductive heat sink 18 includes a substantially solid and rectangular core 32 from which depends a plurality of fins 36. The core 32 and the fins 36 are preferably integrally formed with one another as a monolithic member, meaning that the heat sink 18 is substantially free of joints between the core 32 and the fins 36. The core 32 and the fins 36 are, thus, electrically and thermally conductively connected with one another. Although the heat sinks 18,35 are shown, a wide range of heat sinks may be employed. Alternatively, as shown in FIGS. 6 and 7, a heat sink need not be employed. As another alternative, the heat sink may be replaced by, for example, a copper pad having corresponding mounting dimensions.

The heat sink 18 includes a initial end 40 and a terminal end 44 opposite one another. The initial end 40 has a substantially planar engagement surface (not shown), which electrically and thermally conductively engages the bus 6. The terminal end 44 also has a substantially planar engagement surface, which electrically and thermally conductively engages the fuse 4.

The heat sink 18 includes a pair of substantially cylindrical and threaded sockets 48 formed therein that extend therethrough. The sockets 48 are each configured to threadably receive therein the corresponding fasteners 16, which are threaded fasteners, such as a bolt or a machine screw. It is understood, however, that in other embodiments, the sockets 48 and the fasteners 16 may cooperate in a non-threaded fashion, such as with the use of bayonet fittings, with interference fits between the sockets 48 and the fasteners 16, and with other such attachment or coupling methodologies. If the sockets 48 and fasteners 16 are removably connectable with one another, this will facilitate assembly and disassembly of the power circuit 50 formed by the busses 6,8 (e.g., part of a network protector (not shown) in the field), although such removal is not a requirement of the present invention.

The fasteners 16 protrude from the terminal end 44 of the heat sink 18 and the sockets 48 and extend therethrough. The fasteners 16 include a flared head 60 (as shown in FIG. 3) and an elongated threaded shank 64. Each shank 64 is threadably cooperable with a threaded nut 68. It is understood, however, that the fasteners 16 may be of other configurations, threaded and non-threaded, as indicated above.

Alternatively, a different second set of fasteners (not shown) may be employed for the terminal end 44 of the heat sink (not shown). In that alternative, as disclosed in U.S. Pat. No. 6,510,047, those fasteners are substantially permanently mounted on the heat sink. More specifically, the heat sink is formed by casting an electrically conductive material, such as copper or aluminum, around those fasteners such that the shanks thereof protrude outwardly from the terminal end 44 and such that the heads (not shown) remain disposed internally within the heat sink. In this example, the fastening mechanism 15 for the bus 6 and the heat sink 8 has a relatively shorter length. It is understood, however, that the heat sink 18 may be formed in other fashions and that the second set of fasteners can be mounted on the heat sink 18 in still other fashions.

Regardless of the configuration of the fasteners 16, the nuts 68 are cooperable therewith, whether the cooperation is threadable, is via bayonet fittings, or otherwise. It is preferred, however, that the nuts 68 be removable from the threaded shank 64 to permit removal and replacement of the fuse 4. The fasteners 16 are preferably configured to securely electrically and thermally conductively engage the engagement surface of the terminal end 44 of the heat sink 18 with the corresponding conductive surface of the fuse 4.

Referring to FIGS. 6 and 7, a fuse 70 is directly electrically and mechanically connected to both of the first and second low voltage power busses 6,8. The fuse 70 includes a length 72 between the first and second power busses 6,8, and also includes a width 74 (as shown with the fuse links 88 and 90 of FIGS. 8 and 9, respectively), which is normal to the length 72. The fuse 70 has a first end 76 electrically and mechanically connected to the first low voltage power bus 6 and an opposite second end 78 electrically and mechanically connected to the second low voltage power bus 8. The fuse 70 melts and vaporizes between the non-interrupted state (FIG. 6) and the interrupted state (FIG. 7). A gap 80 is formed in the fuse 70 as such fuse melts and vaporizes. An insulating barrier 82 is driven by a spring 84 between the fuse first and second ends 76,78 after the gap 80 is formed, in order to allow the insulating barrier portion 86 to pass through the fuse gap 80 in the interrupted state (FIG. 7) thereof.

Figure 8:
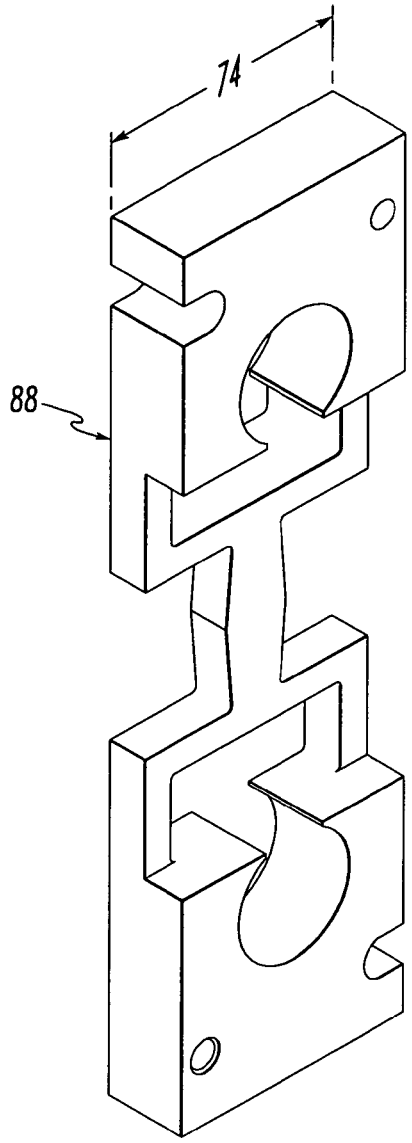
FIG. 8 is an isometric view of a copper Y fuse link.
Figure 9:
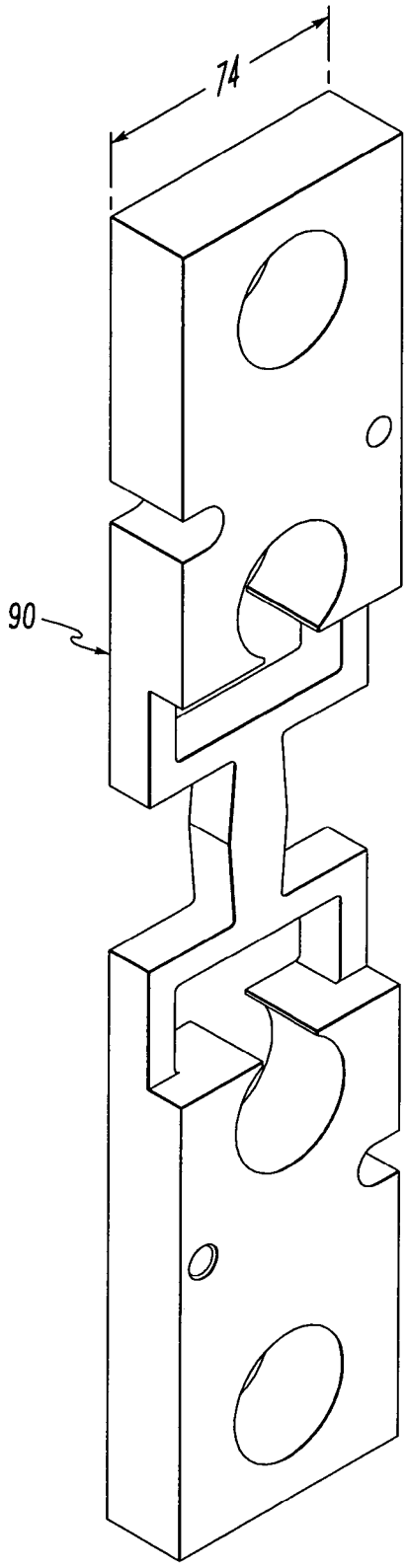
FIG. 9 is an isometric view of a copper Z fuse link.

A wide range of fuses may be employed, such as, for example, a copper Y fuse link 88 (FIG. 8), a copper Z fuse link 90 (FIG. 9) and the S fuse link 4 of FIGS. 1–5. As shown in FIGS. 8 and 9, the copper Y fuse link 88 and the copper Z fuse link 90 are generally planar members.

Referring again to FIG. 3, the S fuse link 4 is a laminated member including a U-shape 92, a first leg portion 94 and a second leg portion 96. The first leg portion 94 is electrically and mechanically connected to the first low voltage power bus 6. The second leg portion 96 is electrically and mechanically connected to the second low voltage power bus 8.

The insulating barrier portion 24 engages the fuse U-shape 92 in the non-interrupted state (FIGS. 1 and 3) thereof. The spring 10 drives the insulating barrier portion 24 through the fuse U-shape 92 in the interrupted state (FIGS. 2, 4 and 5) thereof.

The insulating barrier portion 24 has a suitable length 97 (FIG. 4) and a width 98 (FIG. 5), which is about equal to or greater than the fuse width 100 (FIG. 1). The insulating barrier portion 24 preferably has a thickness of about 0.125 in. to about 0.250 in. The first low voltage power bus 6 is separated from the second low voltage power bus 8 by about 1.0 in.

The insulating barriers 20,82 are advantageous employed to minimize dispersion of vaporized metallic materials and other relatively larger, molten pieces of the fuses 4,70,88,90 throughout a power circuit enclosure (not shown), thereby minimizing damage to protective barriers (not shown), and minimizing carbon and metallic dust over components (not shown) enclosed therein. It will be appreciated that these barriers and fuses may be employed in a wide range of power circuits, including, but not limited to, power circuits employing a network protector, cable fuse connections, and underground power distribution systems.

The insulating barriers 20,82 are inserted by the respective springs 10,84 between the opposite ends of the fuses 4,70 as a sufficient gap is created to allow these barriers to pass through. The barriers 20,82 are made from a suitable arc suppressing material of sufficient size to prevent the arc from passing through the barrier or around it. Before interruption, the springs 10,84 continuously press the barriers 20,82 against the fuses 4,70, respectively. When these fuses 4,70 interrupt, the barriers 20,82 move into the resulting gaps 102,80, respectively, and increase such gap to such a distance, that the arcs are extinguished.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A fuse barrier for a fuse electrically connected between a first low voltage power bus and a second low voltage power bus, said fuse having a non-interrupted state and an interrupted state, said fuse barrier comprising:

a spring including a first portion and a second portion;

a fastener connecting the first portion of said spring to one of said first low voltage power bus and said second low voltage power bus; and an insulating barrier disposed from the second portion of said spring, said insulating barrier engaging a portion of said fuse in the non-interrupted state thereof, said spring driving a portion of said insulating barrier through said fuse in the interrupted state thereof.

2. The fuse barrier of claim 1 wherein said insulating barrier is made of an arc suppressing material.

3. The fuse barrier of claim 2 wherein said arc suppressing material is selected from the group comprising fiber reinforced plastic resin, plastic resin coated fabric, vulcanized fabric and fiber reinforced polyester laminate.

4. The fuse barrier of claim 2 wherein the arc suppressing material of said insulating barrier is adapted to prevent an arc from passing between said first low voltage power bus and said second low voltage power bus as said fuse transitions from said non-interrupted state to said interrupted state, in order to minimize dispersion of vaporized materials and molten portions from said fuse.

5. The fuse barrier of claim 4 wherein said insulating barrier and the arc suppressing material of said insulating barrier are adapted to prevent said arc from passing through or around said insulating barrier.

6. The fuse barrier of claim 1 wherein the second portion of said spring is a second end; and wherein said spring includes at least one fastener, which connects the second end of said spring to said insulating barrier.

7. The fuse barrier of claim 6 wherein the first portion of said spring is a first end; and wherein said insulating barrier includes a first end and a second end, the first end of said insulating barrier including said portion of said insulating barrier, which is adapted to drive through said fuse in the interrupted state thereof, the second end of said insulating barrier being connected to the second end of said spring by said at least one fastener.

8. The fuse barrier of claim 1 wherein said fuse is directly electrically and mechanically connected to both of said first low voltage power bus and said second low voltage power bus.

9. A fuse barrier for a fuse electrically connected between a first low voltage power bus and a second low voltage power bus, said fuse having a non-interrupted state and an interrupted state, said fuse barrier comprising:

a spring including a first end and a second end;

means for disposing the first end of said spring from one of said first low voltage power bus and said second low voltage power bus; and an insulating barrier disposed from the second end of said spring, said insulating barrier engaging a portion of said fuse in the non-interrupted state thereof, said spring driving a portion of said insulating barrier through said fuse in the interrupted state thereof.

10. The fuse barrier of claim 9 wherein said means for disposing includes at least one fastener, which is adapted to connect the first end of said spring to said one of said first low voltage power bus and said second low voltage power bus.

11. The fuse barrier of claim 9 wherein said means for disposing includes at least one fastener, which is adapted to connect the first end of said spring to said first low voltage power bus, and which is also adapted to engage a heat sink.

12. A power circuit comprising:

a first low voltage power bus;

a second low voltage power bus;

a fuse electrically connected between said first low voltage power bus and said second low voltage power bus, said fuse having a non-interrupted state and an interrupted state; and a fuse barrier comprising:

a spring including a first end and a second end, a fastener connecting the first end of said spring to one of said first low voltage power bus and said second low voltage power bus, and an insulating barrier disposed from the second end of said spring, said insulating barrier engaging a portion of said fuse in the non-interrupted state thereof, said spring driving a portion of said insulating barrier through said fuse in the interrupted state thereof.

13. The power circuit of claim 12 wherein said fuse includes a length between said first low voltage power bus and said second low voltage power bus; wherein said fuse also includes a width, which is normal to said length; and wherein the portion of said insulating barrier has a width, which is about equal to or greater than the width of said fuse.

14. The power circuit of claim 13 wherein the portion of said insulating barrier further has a thickness of about 0.125 in. to about 0.250 in.

15. The power circuit of claim 14 wherein said first low voltage power bus is separated from said second low voltage power bus by about 1.0 in.

16. The power circuit of claim 12 wherein said fuse is selected from the group comprising a copper Y fuse link, a copper Z fuse link and an S fuse link.

17. The power circuit of claim 12 wherein said fuse is a generally planar member.

18. The power circuit of claim 12 wherein said fuse is a laminated member including a U-shape, a first leg portion and a second leg portion, said first leg portion being electrically and mechanically connected to said first low voltage power bus, said second leg portion being electrically and mechanically connected to said second low voltage power bus; wherein the portion of said insulating barrier engages the U-shape of said fuse in the non-interrupted state thereof; and wherein said spring drives the portion of said insulating barrier through the U-shape of said fuse in the interrupted state thereof.

19. The power circuit of claim 18 wherein said spring biases said portion of said insulating barrier against the U-shape of said fuse in the non-interrupted state thereof; wherein said fuse melts and vaporizes between said non-interrupted state and said interrupted state; and wherein said spring drives said insulating barrier through said fuse as said fuse transitions from said non-interrupted state to said interrupted state, in order to minimize dispersion of vaporized materials and molten portions from said fuse.

20. The power circuit of claim 12 wherein said fuse has a first end electrically and mechanically connected to said first low voltage power bus and an opposite second end electrically and mechanically connected to said second low voltage power bus; wherein said fuse melts and vaporizes between said non-interrupted state and said interrupted state; wherein a gap is formed in said fuse as said fuse melts and vaporizes; and wherein said insulating barrier is driven by said spring between the first and second ends of said fuse after said gap is formed, in order to allow the portion of said insulating barrier to pass through the gap of said fuse in the interrupted state thereof.

21. The power circuit of claim 12 wherein said fuse has a first end, which is electrically and mechanically connected to a first heat sink, which is electrically and mechanically connected to said first low voltage power bus; and wherein said fuse also has a second end, which is electrically and mechanically connected to a second heat sink, which is electrically and mechanically connected to said second low voltage power bus.

* * * * *